US008544944B1

(12) United States Patent
Gelley

(10) Patent No.: US 8,544,944 B1
(45) Date of Patent: Oct. 1, 2013

(54) STADIUM SEATING ADJUSTABLE STORAGE DEVICE

(76) Inventor: Scott Gelley, New York, NY (US)

( * ) Notice: Subject to any disclaimer, the term of this patent is extended or adjusted under 35 U.S.C. 154(b) by 56 days.

(21) Appl. No.: 13/237,689

(22) Filed: Sep. 20, 2011

(51) Int. Cl.
*A47C 7/62* (2006.01)
*A47C 7/64* (2006.01)
*A47C 7/66* (2006.01)

(52) U.S. Cl.
USPC ..... 297/188.08; 297/188.1; 297/188.02

(58) Field of Classification Search
USPC ..... 297/188.1, 188.01, 188.02, 188.09, 297/188.08
See application file for complete search history.

(56) References Cited

U.S. PATENT DOCUMENTS

| | | | | |
|---|---|---|---|---|
| 628,605 | A | 7/1899 | Ottenheimer | |
| 834,988 | A | 11/1906 | Mallory | |
| 3,077,327 | A * | 2/1963 | Batie et al. | 248/520 |
| 4,799,731 | A | 1/1989 | Brown | |
| 5,015,033 | A | 5/1991 | Winters | |
| 5,490,712 | A | 2/1996 | Drelick | |
| 5,816,463 | A | 10/1998 | Echeverri | |
| 5,820,210 | A | 10/1998 | Shipman et al. | |
| 6,000,752 | A * | 12/1999 | Shyr | 297/188.08 |
| 6,042,180 | A * | 3/2000 | Lombardi | 297/188.11 |
| 6,053,570 | A * | 4/2000 | Stern et al. | 297/188.08 |
| 6,082,816 | A | 7/2000 | Gottlieb et al. | |
| D442,809 | S | 5/2001 | Windt, Jr. et al. | |
| 6,478,371 | B1 | 11/2002 | Clarke | |
| 7,798,569 | B2 | 9/2010 | Comarella | |
| 2006/0006705 | A1 | 1/2006 | Charbonneau | |

* cited by examiner

*Primary Examiner* — David Dunn
*Assistant Examiner* — Timothy J Brindley
(74) *Attorney, Agent, or Firm* — Albert Bordas, P.A.

(57) ABSTRACT

A stadium seating adjustable storage device, having a mounting frame assembly with an anchor wall. Extending from the anchor wall is a sidewall. A storage assembly has first and second lateral walls, a rear wall, and a bottom wall. The first and second lateral walls and the rear wall each have a respective top section, a respective at least one folding section, and a respective bottom section. A plate assembly has an exterior face and first and second ends. The plate assembly mounts onto the storage assembly; and at least one anchor is mounted onto the mounting frame assembly and a stadium styled seat.

18 Claims, 5 Drawing Sheets

STADIUM SEATING ADJUSTABLE STORAGE DEVICE

BACKGROUND OF THE INVENTION

1. Field of the Invention

The present invention relates to stadium seating accessories, and more particularly, to stadium seating adjustable storage devices.

2. Description of the Related Art

While seated at a venue it is often desired to store items in safe, convenient, and secure manner. Applicant is not aware of any stadium seating adjustable storage devices having the novel features of the present invention.

That being said, applicant believes that one of the closest references corresponds to U.S. Patent Application Publication No. 20060006705, published on Jan. 12, 2006 to Charbonneau for Seat Pocket Storage Apparatus. However, it differs from the present invention because Charbonneau teaches a seat storage apparatus for storing an article relative to a seat, the apparatus comprising a flexible first layer, a flexible second layer coupled to the first layer to define a first pocket having a first opening, the first pocket configured to shroudably slide over at least a portion of a seat, and a flexible third layer coupled to the second layer to define a second pocket having a second opening, wherein the second pocket is adjacent to the first pocket and configured to store an article below the seat.

Applicant believes that another references correspond to U.S. Pat. No. 7,798,569 issued to Comarella on Sep. 21, 2010 and corresponding U.S. Patent Application Publication No. 20090079241, published on Mar. 26, 2009 for Storage Bag for Stadium Seats. However, it differs from the present invention because Comarella teaches a storage and advertising bag for a seat that includes a top pocket that slips over the top of a seat. On the other side of the bag is a top pocket that holds advertising material, and beneath that is a storage pocket for holding personal items of a user.

Applicant believes that another reference corresponds to U.S. Pat. No. 6,478,371 issued to Clarke on Nov. 12, 2002 for Retractable and Removable Concession Holder for Stadium Seating. However, it differs from the present invention because Clarke teaches a retractable removable concession holder affixed to permanently attached seating that is commonly found in large capacity entertainment facilities. The concession holder is comprised of a concession container displaying advertising information, a mounting bracket and a seat attachment bracket and a seat attachment portion. The concession container is removably attached to the mounting bracket, which is slidingly attached to the seat attachment portion. The seat attachment portion is permanently affixed to the underside of the seat in such a fashion that the concessions container can be brought from an operating position in between the seated patron's legs to a stowed position under the seat and out of the way of patron. The operating position for the retractable removable concession holder places the concession container in the front of the seat so that the concession container can be detached from the mounting bracket to be replaced with another concessions container containing different advertising information or to be take as a souvenir by the patron.

Applicant believes that another reference corresponds to U.S. Pat. No. 6,082,816 issued to Gottlieb, et al. on Jul. 4, 2000 for Chair Storage Unit. However, it differs from the present invention because Gottlieb, et al. teaches an underseat storage device made of an expandable material, which in a first embodiment comprises an accordion-shaped configuration. Other embodiments include Spandex rope or other mesh type fabrics having other expandable qualities. The material has a top portion having a plurality of VELCRO™ strips clips, magnet(s), screws, bolts, adhesive, wing-nuts, etc. attached thereon, three side portions having accordion folded or other expandable surfaces and a front portion having an articulable flap which opens towards a bottom portion. The storage unit may also include a smaller center container attached to the storage envelope.

Applicant believes that another reference corresponds to U.S. Pat. No. 5,820,210 issued to Shipman, et al. on Oct. 13, 1998 for Storage device for Seating. However, it differs from the present invention because Shipman, et al. teach a storage device for attachment to chairs comprises a frame and a receptacle. The frame has a first part that is proximal to the chair when attached and a second part that is similar in shape to the first part and distal to the chair when attached. In a first embodiment, pegs extend from the inner face of the first part through the side edges of the receptacle and into sockets in the second part of the frame. The two parts of the frame are reversibly connected by conventional fasteners such as screws or bolts. In a second embodiment, detents extend from the inner face of the first part of the frame through the side edges of the receptacle. In both embodiments, a pocket is attached to the bottom of the receptacle and filled with advertising or marketing materials.

Applicant believes that another reference corresponds to U.S. Pat. No. 5,816,463 issued to Echeverri on Oct. 6, 1998 for Sports Pack Attachable to Bleachers/Stadium Seats. However, it differs from the present invention because Echeverri teaches a pack for safely securing personal items below stadium seating at sporting events includes a flexible sack including one or more pockets that can be sealed by a closure flap. One of such pockets may be used to contain a seat cushion to be placed upon such stadium seating. A fastening system is provided for securing the flexible sack to the underside of the stadium seating.

Applicant believes that another reference corresponds to U.S. Pat. No. 5,490,712 issued to Drelick on Feb. 13, 1996 for Storage of Items. However, it differs from the present invention because Drelick teaches a container for the storage of items and strapping the container to the support below its lower surface with a strap that is narrower than the container and extends over the support from a connector on one side of the container to a connector on the opposite side of the container, with an upper surface of the container in contact with a lower surface of the support to permit the container with stored items to be held against a lower surface of the support and elevated above a ground or floor surface to avoid contact with dirt, debris or moisture that may be upon the floor or the ground; when the support is an occupied seat, a retractable cord extending from the occupant to the container can provide a reminder that items are in temporary storage below the seat, so that when the occupant decides to leave the vicinity of the seat, a pull is exerted by the cord against the occupant.

Applicant believes that another reference corresponds to U.S. Pat. No. 5,015,033 issued to Winters on Mat 14, 1991 for Underseat Receptacle for Purses and Other Possessions. However, it differs from the present invention because Winters teaches a receptacle for articles attached by screws, clamps, rivets, or the like, to the underside of any chair having space available beneath its seat. In one preferred form, the receptacle is comprised of a fabric sheet having an elastic border along at least one of its edges. The fabric sheet, shaped to match the configuration of the seat underside, is inconspicuously mounted thereto such that said sheet is substantially flush with the seat underside. In use, access to the receptacle is gained by pulling down the elastic border, which preferably is provided by stitching a hem along one or more edges of the fabric and disposing an elastic cord therein. When the seat underside includes projecting nails, staples or the like, which may injure one reaching into the receptacle, an underseat cover is employed as a protective shield between the receptacle and the seat. In another preferred embodiment, the underseat receptacle is constructed of a rigid material, such as molded plastic, configured as a relatively concave storage shelf having apertured flanges along its top edge. The flanges are bolted or riveted to the underside of a chair. In both embodiments, the underseat receptacle can be attached beneath a seat such that only one occupying the seat will have access to articles stored within the receptacle.

Applicant believes that another reference corresponds to U.S. Pat. No. 4,799,731 issued to Brown on Jan. 24, 1989 for Stadium Seat Cover. However, it differs from the present invention because Brown teaches a stadium seat cover which is slid over the seat portion of a stadium type chair. A pouch is attached to the cover and is provided with a member which has openings for receiving cups and the like and is manually positioned between side attachments to the inside of the pouch.

Applicant believes that another reference corresponds to U.S. Pat. No. 834,988 issued to Mallory on Nov. 6, 1906 for Drawer Attachment for Chairs. However, it differs from the present invention because Mallory teaches a combination of a chair and a drawer under the seat of the chair with flanges on the top and bottom of one side of the drawer, the outer edges of which flanges are bent downwardly and upwardly, respectively, a T-shaped block, the edges of which engage the said flanges, and on which the drawer slides, a pivot extending vertically through said T-shaped block and rigidly secured to the leg of the chair on which said block may swing, substantially as described.

Applicant believes that another reference corresponds to U.S. Pat. No. 628,605 issued to Ottenheimer on Jul. 11, 1899 for Hat Holding Attachment for Chairs. However, it differs from the present invention because Ottenheimer teaches a hat-holding attachment for seats especially designed for the reception of ladies' hats in theaters and other places of entertainment, comprising closed sides and back and open front, said sides and back each formed of parallel sections adapted to be folded and extended.

Applicant believes that another reference corresponds to U.S. Pat. No. D442,809 issued to de Windt, Jr., et al. on May 29, 2001 for Under-Seat Storage Compartment. However, it differs from the present invention because de Windt, Jr., et al. teaches an ornamental design for an under-seat storage compartment.

Other patents describing the closest subject matter provide for a number of more or less complicated features that fail to solve the problem in an efficient and economical way. None of these patents suggests the novel features of the present invention.

SUMMARY OF THE INVENTION

The instant invention is a stadium seating adjustable storage device, comprising a mounting frame assembly having an anchor wall. Extending from the anchor wall is a sidewall. A storage assembly comprises first and second lateral walls, a rear wall, and a bottom wall. The first and second lateral walls and the rear wall each comprise a respective top section, a respective at least one folding section, and a respective bottom section. A plate assembly comprises an exterior face and first and second ends. The plate assembly mounts onto the storage assembly. At least one anchor is mounted onto the mounting frame assembly and a seat assembly.

The mounting frame assembly is in a general u-shape configuration. The respective top section is mounted onto the mounting frame assembly, and more specifically, the sidewall of the mounting frame assembly. A cumulative length of the respective top sections is longer than that of the respective at least one folding sections, and a cumulative length of the respective at least one folding sections is longer than that of the respective bottom sections.

The storage assembly further comprises respective at least one intermediate sections positioned between each respective top sections and the respective bottom sections. The first and second lateral walls and the rear wall are all approximately a same length. The first and second lateral walls are greater in thickness than the rear wall. The bottom wall comprises at least one protruding lip and an edge. The plate assembly further comprises a lip extending at a predetermined angle from the exterior face. The lip is approximately perpendicular to the exterior face. At least one bushing is positioned between the plate assembly and the bottom wall. The first and second lateral walls, the rear wall, and the bottom wall each comprise at least one drainage hole. The exterior face has advertisement thereon. The at least one anchor comprises adhesive means to mount to a seat, and more specifically, the at least one anchor comprises an elongated member having adhesive matter thereon to adhere onto said seat. The elongated member has a housing that receives a bushing and a locking member.

It is therefore one of the objects of this invention to provide a stadium seating adjustable storage device that is volumetrically efficient.

It is another object of this invention to provide a stadium seating adjustable storage device, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
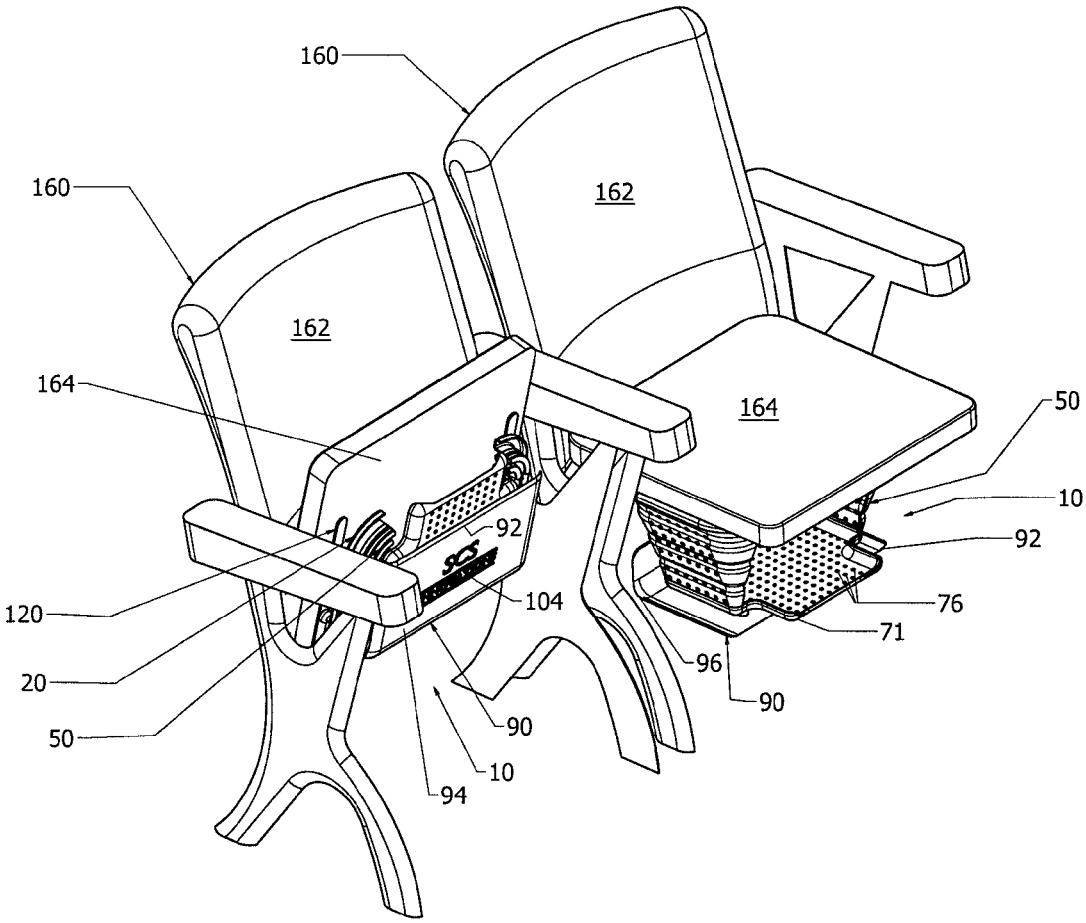
FIG. 1 is an isometric view of the instant invention in a retracted configuration mounted onto a first of two contiguous chairs, and of the instant invention in a protracted configuration mounted onto a second of the two contiguous chairs.

Referring now to the drawings, the present invention is generally referred to with numeral 10. It can be observed that present invention 10 basically includes mounting frame assembly 20, storage assembly 50, plate assembly 90, and at least one anchor 120.

As seen in FIG. 1, stadium seating adjustable storage device 10, is mounted onto seat assembly 160. Seat assembly 160 styles may vary, but will at least comprise a backrest, such as backrest 162, and a seat such as seat 164. In a preferred embodiment, seat 164 is hingedly mounted to backrest 162 or a frame member of seat assembly 160. In a natural state, seat 164 is in an upright configuration as seen on the left side of FIG. 1. Although not illustrated, it is noted that seat 164 remains in the upright configuration with coil or spring means at a hinge with a coil force to cause seat 164 to remain in the upright configuration. At least one anchor 120 is mounted to seat 164, and at least one anchor 120 is mounted onto mounting frame assembly 20. Extending from mounting frame assembly 20 is storage assembly 50, and plate assembly 90 mounts onto storage assembly 50. It is noted that while in the upright configuration, seat 164 is at a predetermined angle so that plate assembly 90, having advertisement 104 thereon, is visible. While in the upright configuration, storage assembly 50 remains in a retracted configuration to allow for better visibility of advertisement 104. Advertisement 104 may be of any style or type. Furthermore, advertisement 104 may comprise a trademark, service mark, logo design, slogan, artwork, illustrations, symbols, and/or characters. In a preferred embodiment, seat assembly 160 provides seating for individuals in stadium, arena, and/or concert venues for sporting events, concerts, operas, and/or plays. An alternate seat assembly may be bleacher-type seating or seats. With bleacher-type seating or seats, instant invention 10 mounts onto a bottom face of each bleacher-type seating or seat and/or assembly.

Seen on the right side of FIG. 1, seat 164 is in a horizontal or nearly horizontal configuration. It is noted that a downward force sufficient to overcome the coil force is required to place seat 164 in the horizontal or nearly horizontal configuration.

Figure 2:
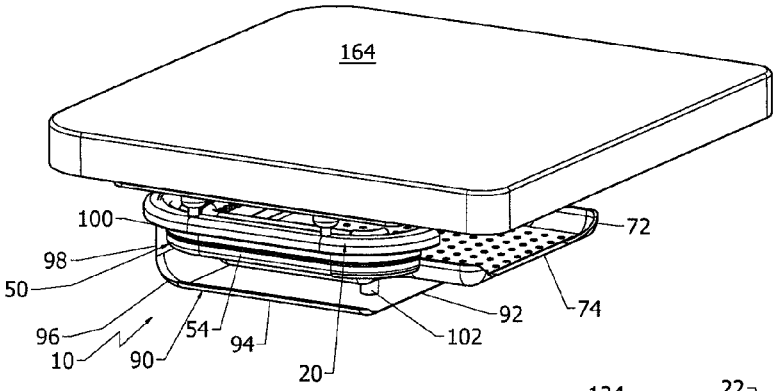
FIG. 2 is an isometric view of instant invention in the retracted configuration mounted onto a seat.

As seen in FIG. 2, while in the horizontal or nearly horizontal configuration, storage assembly 50 also remains in the retracted configuration. However, if desired, storage assembly 50 may be placed in a protracted configuration, as seen on the right side of FIG. 1, to allow sufficient room for storage of articles and/or things. Such articles and/or things as an example may include articles of clothing, footwear, headwear, books, and/or pamphlets.

Figure 3:
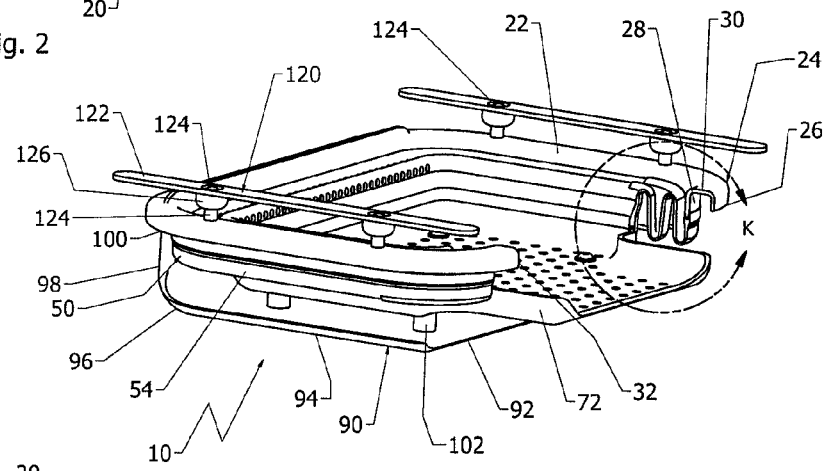
FIG. 3 is an isometric view of instant invention in the retracted configuration.

As seen in FIG. 3, mounting frame assembly 20 has anchor wall 22. Extending from a first side of anchor wall 22 is curved section 24 that terminates at edge 26. Extending from a second side of anchor wall 22 is sidewall 28. In a preferred embodiment, mounting frame assembly 20 is in a general u-shape configuration having ends 30 and 32.

Figure 3A:
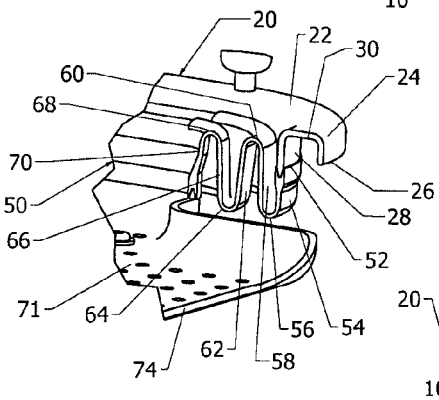
FIG. 3A is a close up view of lateral wall 84 while the instant invention is in the retracted configuration.

As seen in FIG. 3A, extending from mounting frame assembly 20 is storage assembly 50. Storage assembly 50 is made of weather-resistant flexible material having characteristics that enable it to fold at predetermined sections. Storage assembly 50 comprises end 52 and bottom section 70. It is important to note that storage assembly 50 remains in the retracted configuration because it collapses upon itself. Specifically, primarily top section 54; folding section 56; intermediate section 58; folding section 60; intermediate section 62; folding section 64; intermediate section 66, folding section 68, and bottom section 70 fold upon each other in a general zigzag orientation, causing the sections to bias against one another with a bias force. It is noted that top section 54; folding section 56; intermediate section 58; folding section 60; intermediate section 62; folding section 64; intermediate section 66, folding section 68, and bottom section 70 may have a closer or tighter zigzag orientation, whereby top section 54; folding section 56; intermediate section 58; folding section 60; intermediate section 62; folding section 64; intermediate section 66, folding section 68, and bottom section 70 may contact one another. This enables storage assembly 50 to remain in the retracted configuration until a force overcomes the bias force to place in the protracted configuration.

Figure 4:
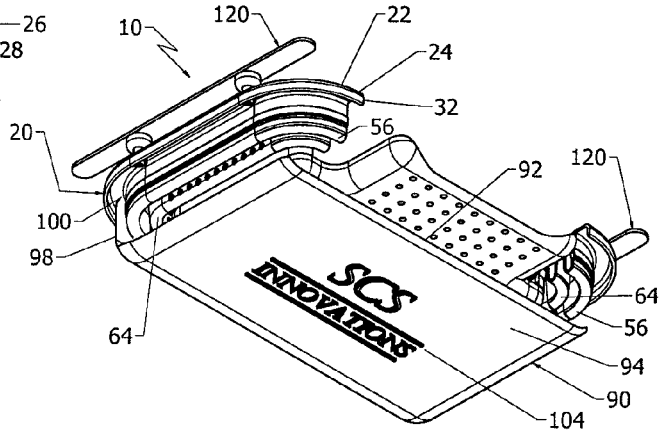
FIG. 4 is an isometric view of the plate assembly while the instant invention in the retracted configuration.

As seen in FIGS. 2 and 4, plate assembly 90 comprises exterior face 94, and ends 92 and 100. Plate assembly 90 further comprises lip 98 extending at a predetermined angle from exterior face 94. Positioned between lip 98 and exterior face 94 is section 96. Lip 98 is approximately perpendicular to exterior face 94. Exterior face 94 has advertisement 104 thereon. Plate assembly 90, with bushing 102 there between, mounts onto storage assembly 50. Bushings 102 create a predetermined distance between plate assembly 90 and storage assembly 50 to allow for drainage.

Figure 5:
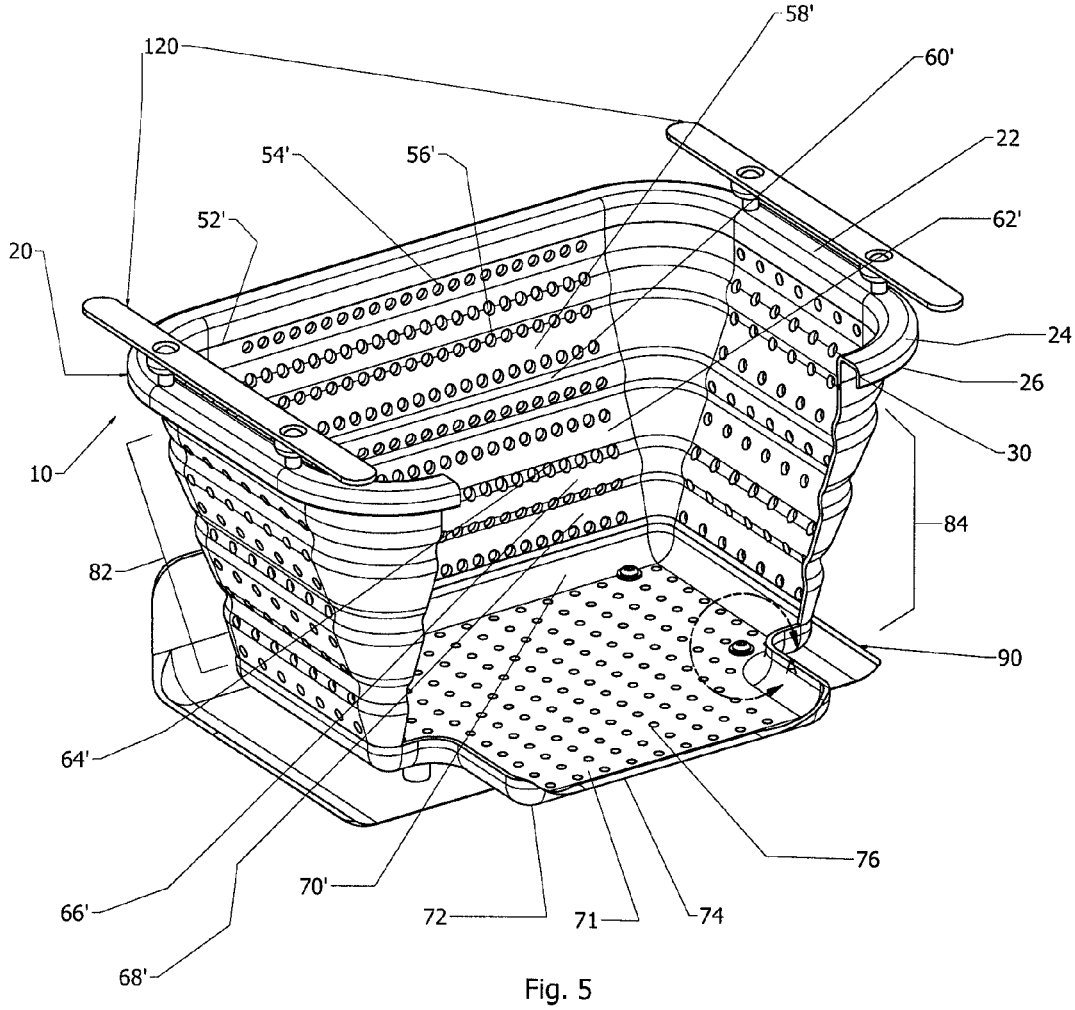
FIG. 5 is an isometric view of the instant invention in the protracted configuration.
Figure 7:
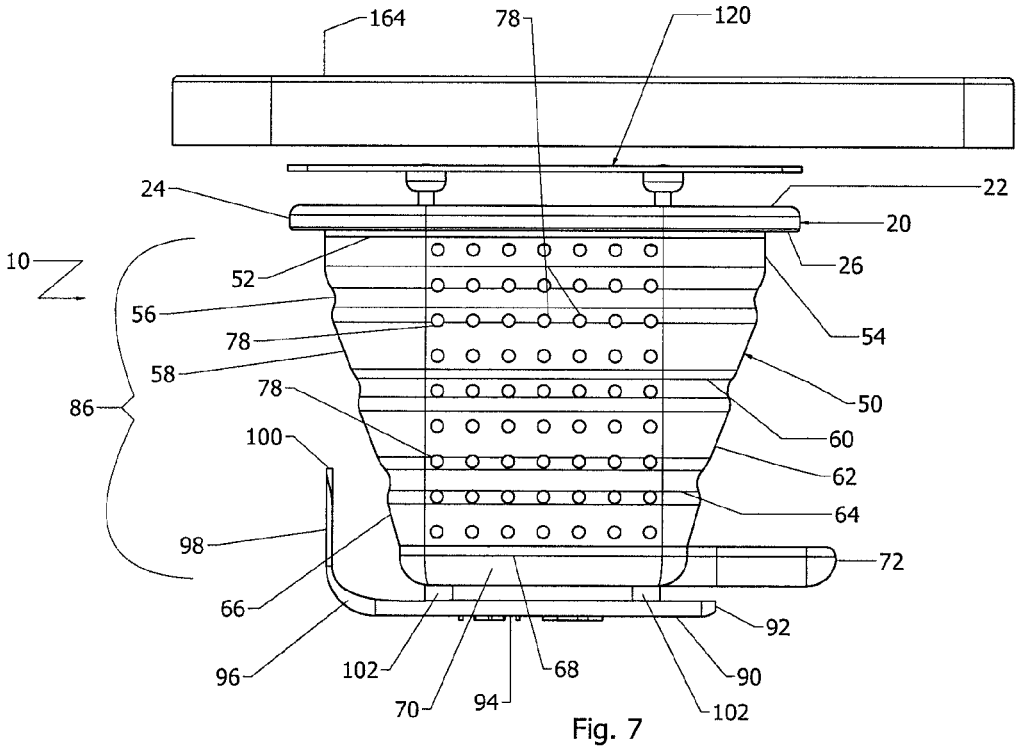
FIG. 7 is a side elevation view of the instant invention in the protracted configuration.

As seen in FIGS. 5 and 7, storage assembly 50 comprises lateral walls 82 and 84, and rear wall 86. Storage assembly 50 further comprises bottom wall 71 having protruding lips 72 and edge 74. Bottom wall 71 has at least one drainage hole 76. Lateral walls 82 and 84 each comprise end 52; top section 54; folding section 56; intermediate section 58; folding section 60; intermediate section 62; folding section 64; intermediate section 66; folding section 68, and bottom section 70. Rear wall 86 comprises end 52'; top section 54'; folding section 56'; intermediate section 58'; folding section 60'; intermediate section 62'; folding section 64'; intermediate section 66'; folding section 68' and bottom section 70'. Lateral walls 82 and 84 may be thicker than rear wall 86.

Top section 54; folding section 56; intermediate section 58; folding section 60; intermediate section 62; folding section 64; intermediate section 66; folding section 68, and bottom section 70; and top section 54'; folding section 56'; intermediate section 58'; folding section 60'; intermediate section 62'; folding section 64'; intermediate section 66'; folding section 68', and bottom section 70' may each have at least one drainage hole 78. Top sections 54 and 54' are mounted onto mounting frame assembly 20, and more specifically, onto sidewall 28, as seen in FIG. 3A, of mounting frame assembly 20. Lateral walls 82 and 84 and rear wall 86 are all approximately of the same length.

A cumulative length of respective top sections 54 and 54' are longer than that of respective folding sections 56 and 56'. A cumulative length of respective folding sections 56 and 56' are longer than that of respective intermediate sections 58 and 58'. A cumulative length of respective intermediate sections 58 and 58' are longer than that of respective folding sections 60 and 60'. A cumulative length of respective folding sections 60 and 60' are longer than that of respective intermediate sections 62 and 62'. A cumulative length of respective intermediate sections 62 and 62' are longer than that of respective folding sections 64 and 64'. A cumulative length of respective folding sections 64 and 64' are longer than that of respective intermediate sections 66 and 66'. A cumulative length of respective intermediate sections 66 and 66' are longer than that of respective folding sections 68 and 68'. A cumulative length of respective folding sections 68 and 68' are longer than that of respective bottom sections 70 and 70'.

Figure 5A:
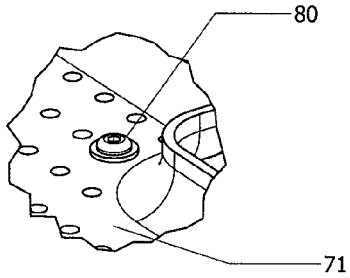
FIG. 5A is a close up view of bolt 80.

As seen in FIG. 5A, bolt 80 is used to secure storage assembly 50 to plate assembly 90.

Figure 6:
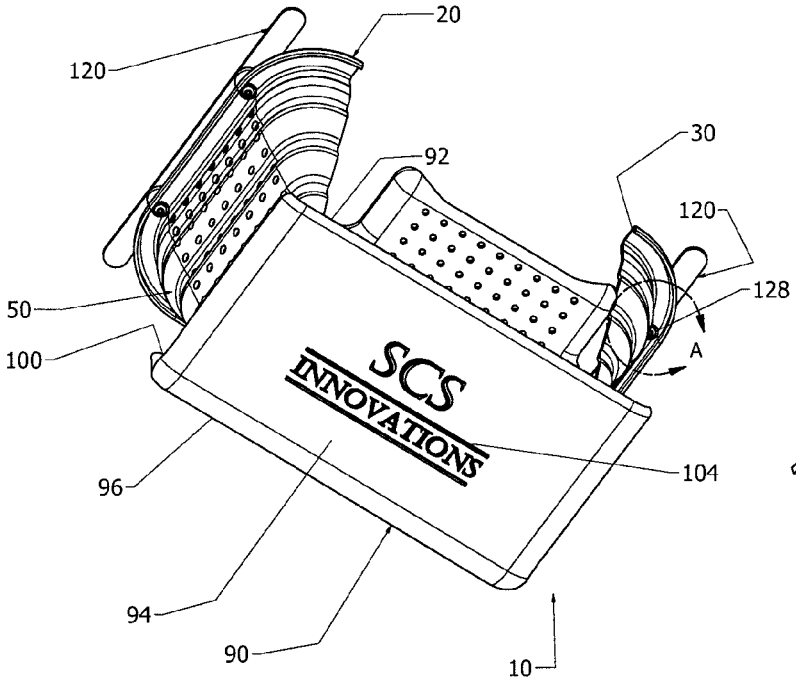
FIG. 6 is an isometric bottom view of the instant invention in the protracted configuration.
Figure 6A:
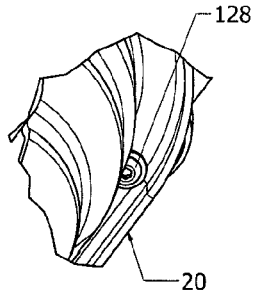
FIG. 6A is a close up view of bolt 138.

As seen in FIGS. 6 and 6A, bolt 138 is used to secure storage assembly 50 to mounting frame assembly 20.

As seen in FIG. 7, plate assembly 90 comprises lip 98 having end 100 extending at a predetermined angle from exterior face 94. Positioned between lip 98 and exterior face 94 is section 96, whereby lip 98 is approximately perpendicular to exterior face 94. When storage assembly 50 is in the retracted configuration, lip 98 prevents it from collapsing completely, whereby end 100 makes contact with mounting frame assembly 20.

Figure 8:
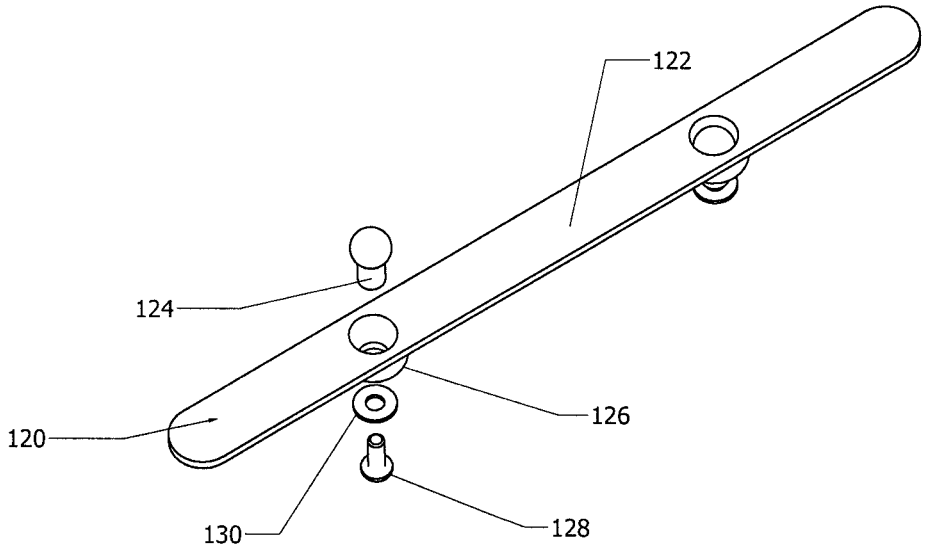
FIG. 8 is an exploded view of the at least one anchor 120.
Figure 8A:
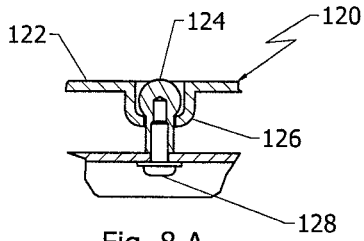
FIG. 8A is a partial sectional view of the at least one anchor 120 seen in FIG. 3.

As seen in FIGS. 8 and 8A, at least one anchor 120 comprises elongated member 122, bushing 124, housing 126, locking member 128 and washer 130. Each at least one anchor 120 may comprise adhesive means to mount elongated member 122 to seat 164. It is noted that bushing 124 has a head that fills a cavity defined by housing 126.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A stadium seating adjustable storage device, comprising:

A) a mounting frame assembly having an anchor wall, extending from said anchor wall is a sidewall;

B) a storage assembly comprising first and second lateral walls, a rear wall, and a bottom wall, said first and second lateral walls and said rear wall each comprises a respective top section, a respective at least one folding section, and a respective bottom section;

C) a plate assembly comprising an exterior face and a first end, said plate assembly mounts onto said storage assembly, said plate assembly further comprising a lip extending at a predetermined angle from said exterior face, said lip comprising a second end, at least one first bushing is positioned between said plate assembly and said bottom wall, said at least one first bushing creating a predetermined distance between said plate assembly and said storage assembly to allow for drainage, when said storage assembly is in a retracted configuration, said lip prevents said storage assembly from collapsing completely, whereby said second end makes contact with said mounting frame assembly; and D) at least one anchor mounted onto said mounting frame assembly.

2. The stadium seating adjustable storage device set forth in claim 1, further characterized in that said mounting frame assembly is in a general u-shape configuration.

3. The stadium seating adjustable storage device set forth in claim 1, further characterized in that each said respective top section is mounted onto said mounting frame assembly.

4. The stadium seating adjustable storage device set forth in claim 1, further characterized in that each said respective top section is mounted onto said sidewall of said mounting frame assembly.

5. The stadium seating adjustable storage device set forth in claim 1, further characterized in that a cumulative length of said respective top sections is longer than that of said respective at least one folding sections.

6. The stadium seating adjustable storage device set forth in claim 1, further characterized in that a cumulative length of said respective at least one folding sections is longer than that of said respective bottom sections.

7. The stadium seating adjustable storage device set forth in claim 1, further characterized in that said storage assembly further comprises respective at least one intermediate sections positioned between each said respective top sections and said respective bottom sections.

8. The stadium seating adjustable storage device set forth in claim 1, further characterized in that said first and second lateral walls and said rear wall are all approximately a same length.

9. The stadium seating adjustable storage device set forth in claim 1, further characterized in that said first and second lateral walls are greater in thickness than said rear wall.

10. The stadium seating adjustable storage device set forth in claim 1, further characterized in that said bottom wall comprises at least one protruding lip and an edge.

11. The stadium seating adjustable storage device set forth in claim 1, further characterized in that said lip is approximately perpendicular to said exterior face.

12. The stadium seating adjustable storage device set forth in claim 1, further characterized in that said first and second lateral walls, said rear wall, and said bottom wall each comprise at least one drainage hole.

13. The stadium seating adjustable storage device set forth in claim 1, further characterized in that said exterior face has advertisement thereon.

14. The stadium seating adjustable storage device set forth in claim 1, further characterized in that each said at least one anchor comprises adhesive means to mount to a seat.

15. The stadium seating adjustable storage device set forth in claim 14, further characterized in that said at least one anchor comprises an elongated member having adhesive matter thereon to adhere onto said seat.

16. The stadium seating adjustable storage device set forth in claim 1, further characterized in that said at least one anchor comprises an elongated member having a housing.

17. The stadium seating adjustable storage device set forth in claim 16, further characterized in that said housing receives a second bushing.

18. The stadium seating adjustable storage device set forth in claim 1, further characterized in that said at least one anchor comprises an elongated member having a housing that receives a second bushing and a locking member.

* * * * *